US011167202B2

(12) United States Patent
Sennwald

(10) Patent No.: US 11,167,202 B2
(45) Date of Patent: Nov. 9, 2021

(54) THREE-DIMENSIONAL GAME BOARD

(71) Applicant: EINSTEINMILL (SHANGHAI) LTD., Shanghai (CN)

(72) Inventor: Bertran Marc Sennwald, Zurich (CH)

(73) Assignee: Einsteinmill (Shanghai) Ltd., Shanghai (CN)

( * ) Notice: Subject to any disclaimer, the term of this patent is extended or adjusted under 35 U.S.C. 154(b) by 0 days.

(21) Appl. No.: 16/772,247

(22) PCT Filed: Jan. 31, 2019

(86) PCT No.: PCT/CN2019/074100
§ 371 (c)(1),
(2) Date: Jun. 12, 2020

(87) PCT Pub. No.: WO2019/114843
PCT Pub. Date: Jun. 20, 2019

(65) Prior Publication Data

US 2021/0069578 A1 Mar. 11, 2021

(30) Foreign Application Priority Data

Dec. 15, 2017 (CN) ..... 201721754285.3

(51) Int. Cl.
*A63F 3/00* (2006.01)
*A63F 3/02* (2006.01)

(52) U.S. Cl.
CPC ..... *A63F 3/00214* (2013.01); *A63F 3/00533* (2013.01); *A63F 3/00697* (2013.01);
(Continued)

(58) Field of Classification Search
CPC ..... A63F 3/00214; A63F 3/00533; A63F 3/00697; A63F 3/02; A63F 2003/0022;
(Continued)

(56) References Cited

U.S. PATENT DOCUMENTS 1,262,312 A * 4/1918 Dewante ..... A63F 3/00094 273/264
4,884,817 A * 12/1989 Johnson ..... A63F 3/00214 273/241
(Continued)

FOREIGN PATENT DOCUMENTS

CN 1042086 5/1990
CN 2379178 5/2000
(Continued)

OTHER PUBLICATIONS

International Search Report and Written Opinion of PCT Application No. PCT/CN2019/074100, dated Apr. 26, 2019.

*Primary Examiner* — Michael D Dennis
(74) *Attorney, Agent, or Firm* — Dinsmore & Shohl LLP

(57) ABSTRACT

The invention provides a three-dimensional game board, comprising at least two tiers of board frames arranged up and down, each tier comprising at least one square frame, the size of each square frame in each tier varying, and on each square frame, a position for setting a piece being provided on each of four corners and on the midpoint of each of four sides; four support frames are arranged among the square frames in each tier of the board frame, which connect the positions at the midpoints of corresponding sides of each of the square frames to form a three-dimensional game board.

10 Claims, 11 Drawing Sheets

(52) U.S. Cl.
CPC ..... *A63F 3/02* (2013.01); *A63F 2003/0022* (2013.01); *A63F 2003/0057* (2013.01); *A63F 2003/00545* (2013.01); *A63F 2003/00706* (2013.01)

(58) Field of Classification Search
CPC .... A63F 2003/00545; A63F 2003/0057; A63F 2003/00706
See application file for complete search history.

(56) References Cited

U.S. PATENT DOCUMENTS

| | | | | | |
|---|---|---|---|---|---|
| 5,033,751 | A * | 7/1991 | Ching | A63F 3/00214 | 273/241 |
| 5,112,056 | A | 5/1992 | Ching | | |
| 5,249,805 | A * | 10/1993 | Neil | A63F 9/0468 | 273/241 |
| 5,429,370 | A * | 7/1995 | Binder | A63F 3/02 | 273/264 |
| 6,276,685 | B1 * | 8/2001 | Sterling | A63F 3/00214 | 273/236 |
| 2018/0126255 | A1 * | 5/2018 | Hotchkiss | A63F 3/00094 | |

FOREIGN PATENT DOCUMENTS

| | | | | |
|---|---|---|---|---|
| CN | 207640937 | | 7/2018 | |
| CN | 304743106 | | 7/2018 | |
| DE | 19924399 | * | 7/2000 | A63F 3/02 |
| WO | 9419075 | | 9/1994 | |

* cited by examiner

THREE-DIMENSIONAL GAME BOARD

CROSS-REFERENCE TO RELATED APPLICATIONS

The present application is a National Phase Entry of International Application No. PCT/CN2019/074100, entitled "THREE-DIMENSIONAL GAME BOARD" and filed on Jan. 31, 2019, which claims priority to Chinese Patent Application No. 201721754285.3 filed with the National Intellectual Property Administration, PRC on Dec. 15, 2017, the entire contents of both are incorporated herein by reference.

BACKGROUND OF THE INVENTION

1. Field of the Invention

The present invention relates to the field of boards, and in particular to a three-dimensional game board, which is suitable for a Mill game.

2. The Related Art

The Mill game is a planar board strategic game with the earliest origin traced back to Egypt and becoming popular in Rome later, and is a strategic game between two game players. This game is also known as "Nine Men's Morris". "Nine Men's Morris" also has three main variants: Three Men's Morris, Six Men's Morris, and Twelve Men's Morris.

The rules of the game of Nine Men's Morris consist in that: a board consists of a grid with 24 intersections or points; each player has nine pieces usually in black or white; each player holds pieces of one color; during the game, each player tries to place his pieces to form a "mill" (factory or territory), that is, any three pieces of the same color are in one horizontal straight line or one vertical straight line; the successful player may remove one opponent piece each time; and the game ends when one player has only the last 2 pieces left or cannot make any further movement on the board, then his opponent wins.

The whole process of the game mainly comprises three phases. The first phase is placing pieces, in which the game starts with an empty board; the players first decide who will play first and then take turns placing their pieces on empty positions on the board; if one of the players can place his three pieces horizontally or vertically in one straight line, he has created a "mill" (factory or territory) and may remove one of the pieces of his opponent from the board and the game; a piece to be removed may be selected, except for those in a "mill" (factory or territory) that the opponent has created; and the game enters a second phase when all the pieces are placed.

The second phase is moving the pieces, in which the players continue to take turns moving their pieces, and in this phase, a piece is to be moved into an adjacent position; one piece cannot jump over another piece; as in the first phase, the players continue to try to form "mills" (factories or territories) and remove the opponent's pieces; the players may break their own "mill" (factory or territory) that has been formed and move one of the pieces therefrom, and then repeatedly move the piece back to create the same "mill" (factory or territory), and each time the piece is moved back, one of the pieces of the opponent may be removed; this act of removing the opponent's piece is commonly known as "pounding" the opponent; and the game enters a third phase when the pieces of one of the players on the board are reduced to the last three ones.

The third phase is "flying", in which if the pieces of one of the players are reduced to the last three ones, the player is no longer restricted to move his piece only to an adjacent position, instead the player's piece can "fly" from any position to any empty position.

FIG. 1 is a schematic diagram of a board for Three Men's Morris in the prior art. FIG. 2 is a schematic diagram of a board for Six Men's Morris in the prior art. FIG. 3 is a schematic diagram of a board for Nine Men's Morris in the prior art.

As shown in FIG. 1, the board for Three Men's Morris is a grid in the form of the character "米" with a 2×2 square. Each player holds three pieces, the pieces are placed at various nodes of the grid, and one player wins when his three pieces are in one straight line.

As shown in FIG. 2, the board for Six Men's Morris consists of two concentric squares located on the same plane, and two corresponding sides of the two squares are connected to each other. Each player holds six pieces, and the pieces are placed at various nodes on the board.

As shown in FIG. 3, the board for Nine Men's Morris consists of three concentric squares located on the same plane. Three corresponding sides of the three squares are connected to each other, and the board with intersected straight lines has 24 intersections or points. Each player holds nine pieces, and the pieces are placed at various nodes on the board.

On the basis of the above board for Nine Men's Morris, the board for Twelve Men's Morris has four diagonal lines added to connect three concentric squares at their corners. Each player holds twelve pieces, and the pieces can be placed and form "mills" on diagonals. Twelve Men's Morris is also known as "Morabaraba".

It can be known from the foregoing description of the boards that the boards used in the board strategic games are all made to be planar at present. Such planar boards are relatively monotonous and traditional, resulting in ordinary user experience. As people deepen their experiences in games, the requirements for strategic board games are getting higher. For example, traditional planar boards might not meet the increasing demands of people.

In view of this, those skilled in the art certainly aspire to further develop a more strategic, intellectual, and interesting game board in order to improve the user experience.

SUMMARY

The technical problem to be solved by the present invention is to overcome the defect of monotonous and traditional user experience resulting from a planar board used in a board strategic game in the prior art and to provide a three-dimensional game board.

The present invention solves the above technical problem by the following technical solution a three-dimensional game board, wherein the three-dimensional game board comprises at least two tiers of board frames arranged up and down, each tier of the board frame comprising at least one square frame, the size of each of the square frames in each tier of the board frame varying from one to another, and on each of the square frames, a position for setting a piece being provided on each of four corners and on the midpoint of each of four sides;

four support frames are arranged among the square frames in each tier of the board frames, which connect the positions at the midpoints of corresponding sides of each of the square frames to form a three-dimensional game board, achieving a plurality of forms in which three pieces are in one straight line in a three-dimensional space.

According to an embodiment of the present invention, the three-dimensional game board comprises a first tier of board frame and a second tier of board frame, the first tier of board frame comprising a first square frame, the second tier of board frame comprising a second square frame, and the first square frame being smaller than the second square frame.

According to an embodiment of the present invention, the three-dimensional game board comprises a first tier of board frame, a second tier of board frame, and a third tier of board frame, the first tier of board frame comprising a first square frame, the second tier of board frame comprising a second square frame, the third tier of board frame comprising a third square frame, and the sizes of the first square frame, the second square frame and the third square frame increasing in sequence.

According to an embodiment of the present invention, the three-dimensional game board comprises a first tier of board frame, a second tier of board frame, and a third tier of board frame, the first tier of board frame comprising a first square frame and a second square frame, the second tier of board frame comprising a third square frame, and the third tier of board frame comprising a fourth square frame and a fifth square frame;

the first square frame is larger than the second square frame, and the third square frame is larger than the second square frame and smaller than the first square frame; and the size of the fourth square frame is equal to that of the first square frame, and the size of the fifth square frame is equal to that of the second square frame.

According to an embodiment of the present invention, the support frame is an X-shaped support, two upper legs of the X-shaped support being respectively connected to the first square frame and the second square frame, two lower legs of the X-shaped support being respectively connected to the fourth square frame and the fifth square frame, and a middle cross portion of the X-shaped support being connected to the third square frame.

According to an embodiment of the present invention, the X-shaped support is detachably connected to each square frame.

According to an embodiment of the present invention, each of the two upper legs, the two lower legs, and the middle cross portion of each of the X-shaped supports is provided with a recess, an H-shaped junction is arranged at a midpoint of each side of the first square frame, the second square frame, the third square frame, the fourth square frame and the fifth square frame, and each of the H-shaped junctions is integrally fastened to the corresponding recess to form a position.

According to an embodiment of the present invention, at least one magnet is mounted on the H-shaped junction, and at least one metal piece is disposed in the recess, such that the recess and the corresponding H-shaped junction are magnetically attracted together;

or the magnet is mounted in the recess, and the metal piece is disposed on the H-shaped junction, such that the H-shaped junction and the corresponding recess are magnetically attracted together.

According to an embodiment of the present invention, the H-shaped junction and the recess are connected by means of at least one fastener, plugging, or at least one hook and loop.

According to an embodiment of the present invention, at least one magnet is mounted on the H-shaped junction and in the recess, respectively, and the H-shaped junction and the recess are connected by means of attraction between magnets.

According to an embodiment of the present invention, the three-dimensional game board is made of acrylic, stainless steel, glass, plastic, crystal, aluminum, wood, bamboo, metal, or carbon.

According to an embodiment of the present invention, the position is in the shape of a square with rounded corners, a square, a circle, a triangle, or a polygon.

The positive and progressive effects of the present invention are as follows:

The three-dimensional game board of the present invention breaks through the limitation of planar board, which is redesigned into a three-dimensional game board, and incorporates the concept of a three-dimensional space, such that the original planar game can be played in the three-dimensional space. The three-dimensional game board makes the game more strategic, intellectual and interesting, and improves the spatial cognition and game experience of players.

In addition, in the three-dimensional game board of the present invention, the structure of the three-dimensional game board is further configured to be detachable, such that the board can be assembled or disassembled simply and easily. In this way, the game board can be conveniently stored, managed, carried or transported, which not only saves on space but also has a logistics advantage. No matter in a three-dimensional state or in a stored state after disassembly, the three-dimensional game board exhibits a stylish line structure with functionality and aesthetics.

BRIEF DESCRIPTION OF THE DRAWINGS

The above-mentioned and other features, properties and advantages of the present invention will become more apparent from the following description of the embodiments with reference to the accompanying drawings, and the same reference numerals denote the same features throughout the figures, in which.

DETAILED DESCRIPTION OF EMBODIMENTS

Figure 1:
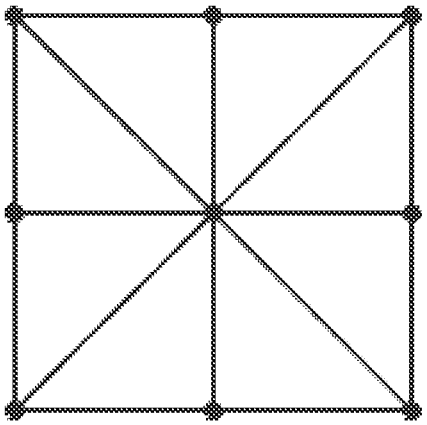
FIG. 1 is a schematic diagram of a board for Three Men's Morris in the prior art.
Figure 2:
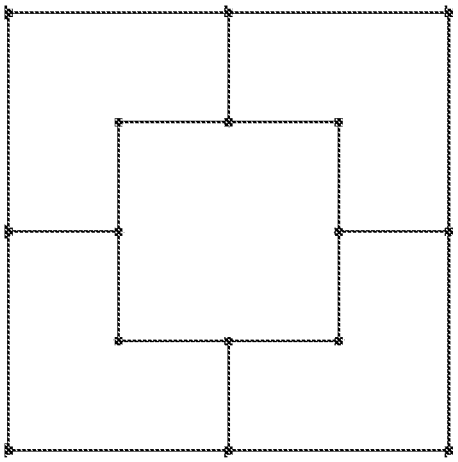
FIG. 2 is a schematic diagram of a board for Six Men's Morris in the prior art.
Figure 3:
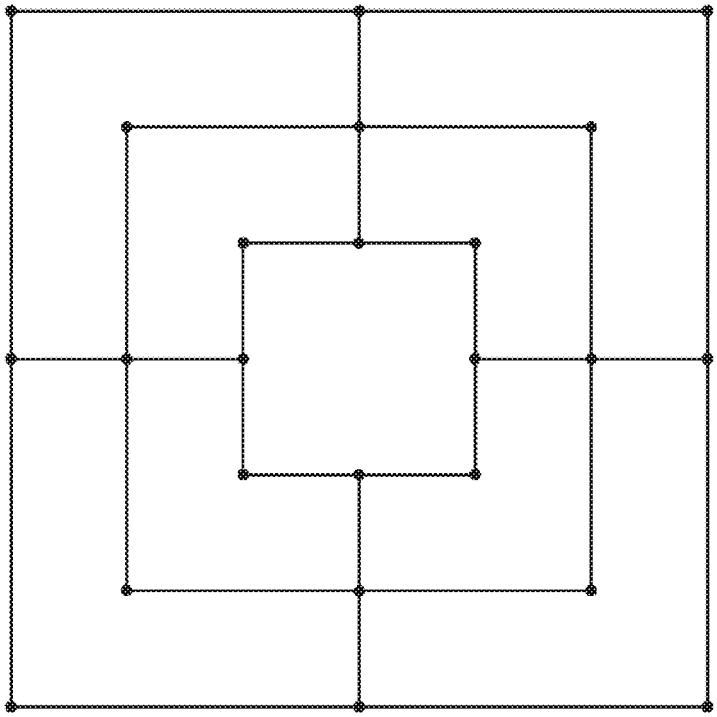
FIG. 3 is a schematic diagram of a board for Nine Men's Morris in the prior art.

To make the above objectives, features and advantages of the present invention more apparent and easier to understand, specific embodiments of the present invention will be described in detail below with reference to the accompanying drawings.

Embodiments of the present invention will now be described in detail with reference to the accompanying drawings. Reference will now be made in detail to preferred embodiments of the present invention, examples of which are illustrated in the accompanying drawings. The same reference numerals used throughout the figures denote identical or similar parts wherever possible.

Furthermore, although the terms used in the present invention are selected from well-known common terms, some of the terms mentioned in the description of the present invention may have been selected by the applicant according to his or her determination, and the detailed meaning thereof is described in the relevant section described herein.

Furthermore, the present invention must be understood, not simply by the actual terms used but also by the meanings encompassed by each term.

The present invention discloses a three-dimensional game board, which comprises at least two tiers of board frames arranged up and down, each tier of the board frame comprising at least one square frame, the size of each of the square frames in each tier of the board frame varying from one to another, and on each of the square frames, a position for setting a piece being provided on each of four corners and on the midpoint of each of four sides. Four support frames are arranged among the square frames in each tier of the board frame, which connect the positions at the midpoints of corresponding sides of each of the square frames to form a three-dimensional game board, achieving a plurality of forms in which three pieces are in one straight line in a three-dimensional space.

The above-mentioned three-dimensional game board is suitable for various forms of the traditional board strategic game "Mill". As an example, for "Three Men's Morris", specifically, the three-dimensional game board comprises a first tier of board frame and a second tier of board frame, the first tier of board frame comprising a first square frame, the second tier of board frame comprising a second square frame, and the first square frame being smaller than the second square frame.

As another example, for "Six Men's Morris", specifically, the three-dimensional game board comprises a first tier of board frame, a second tier of board frame, and a third tier of board frame, the first tier of board frame comprising a first square frame, the second tier of board frame comprising a second square frame, the third tier of board frame comprising a third square frame, and the sizes of the first square frame, the second square frame and the third square frame increasing in sequence.

It can be known from the above description that, according to the different games used, the layout of the three-dimensional game board can be changed by increasing or decreasing the number of the tiers of the board, increasing or decreasing the number of the square frames in each tier of board frame, and adjusting the number and connection positions of the support frames, as long as the rules of corresponding "Mill" games are complied with. As an example, for "Nine Men's Morris", the three-dimensional game board can be arranged in three tiers, wherein the first tier is provided with two square frames, the second tier is provided with one square frame, the third tier is provided with two square frames, and four support frames are arranged to connect central positions of corresponding sides of the square frames in each tier.

As another example, for "Twelve Men's Morris", on the basis of the above "Nine Men's Morris", support frames are added to connect the square frames in each tier at four corners to form a three-dimensional game board complying with the rules of the game. Each player holds 12 pieces, and the pieces are placed at various nodes on the board.

In order to describe the present invention in further detail, this embodiment is described in detail by taking a three-dimensional game board suitable for a Mill game as an example.

Figure 4:
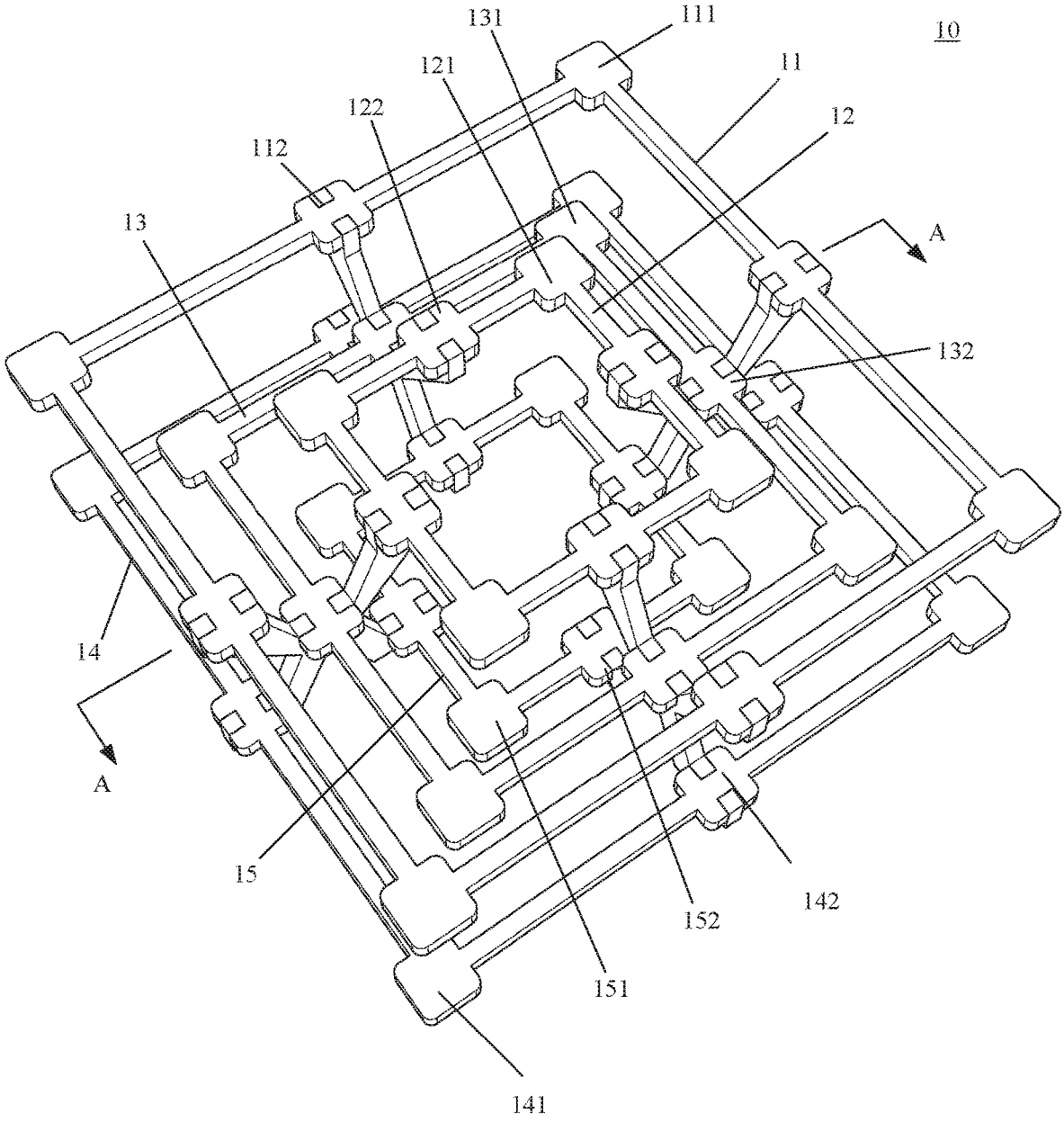
FIG. 4 is a perspective view of a three-dimensional game board of the present invention.
Figure 5:
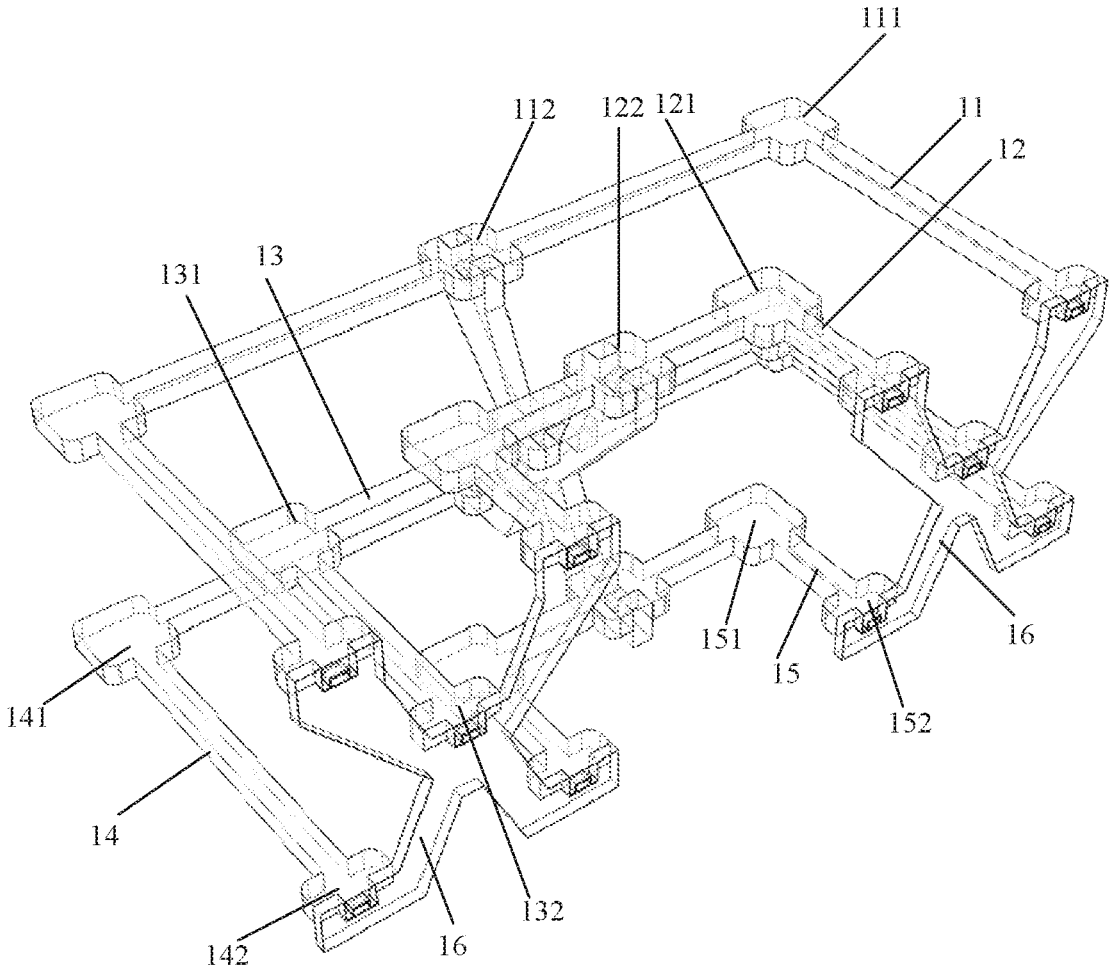
FIG. 5 is a schematic cutaway view along the line A-A in FIG. 4, wherein the three-dimensional game board is made of a transparent material.
Figure 6:
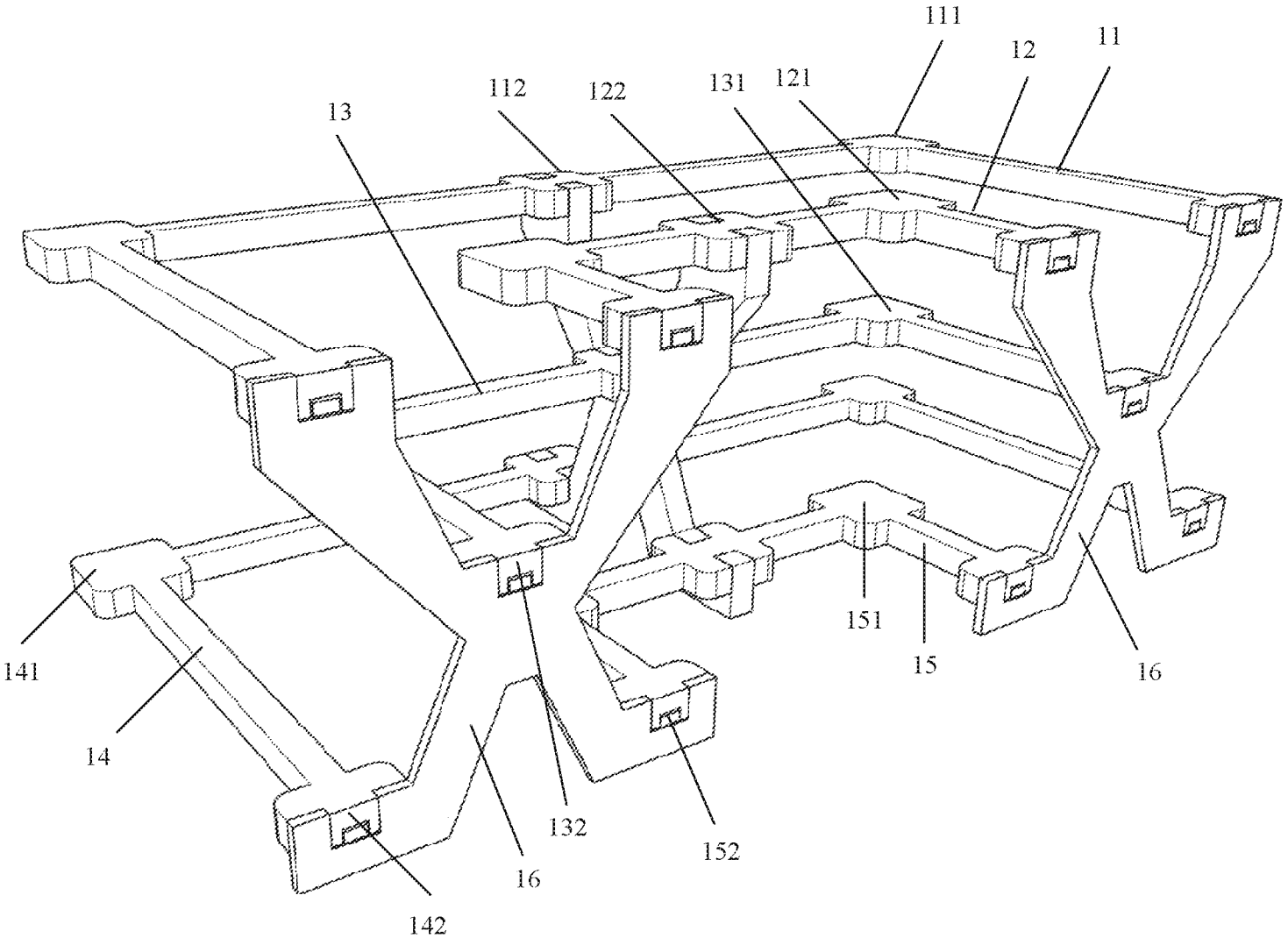
FIG. 6 is a schematic cutaway view along the line A-A in FIG. 4, wherein the three-dimensional game board is made of an opaque material.
Figure 7:
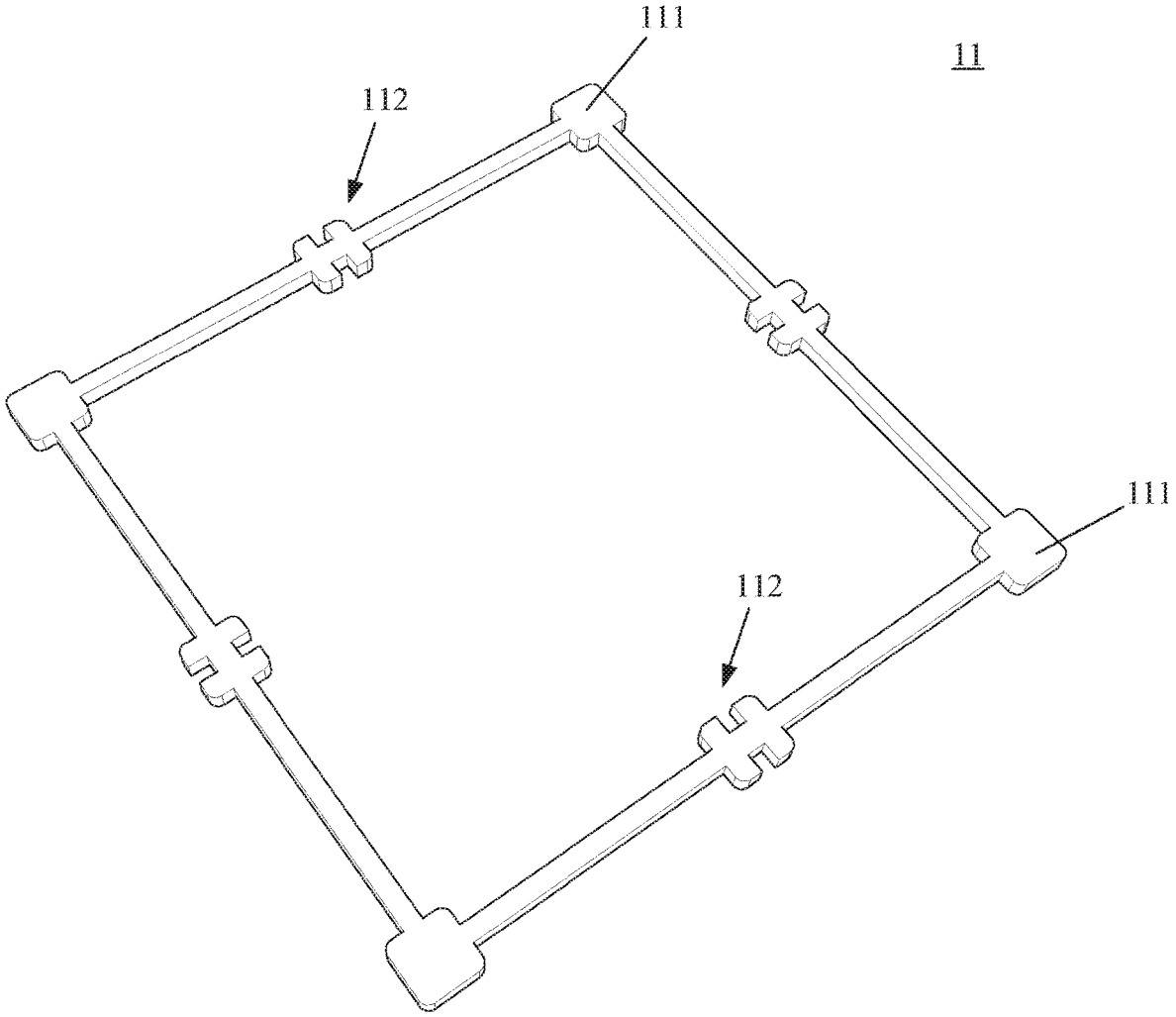
FIG. 7 is a schematic structural diagram of a first square frame in the three-dimensional game board of the present invention.
Figure 8:
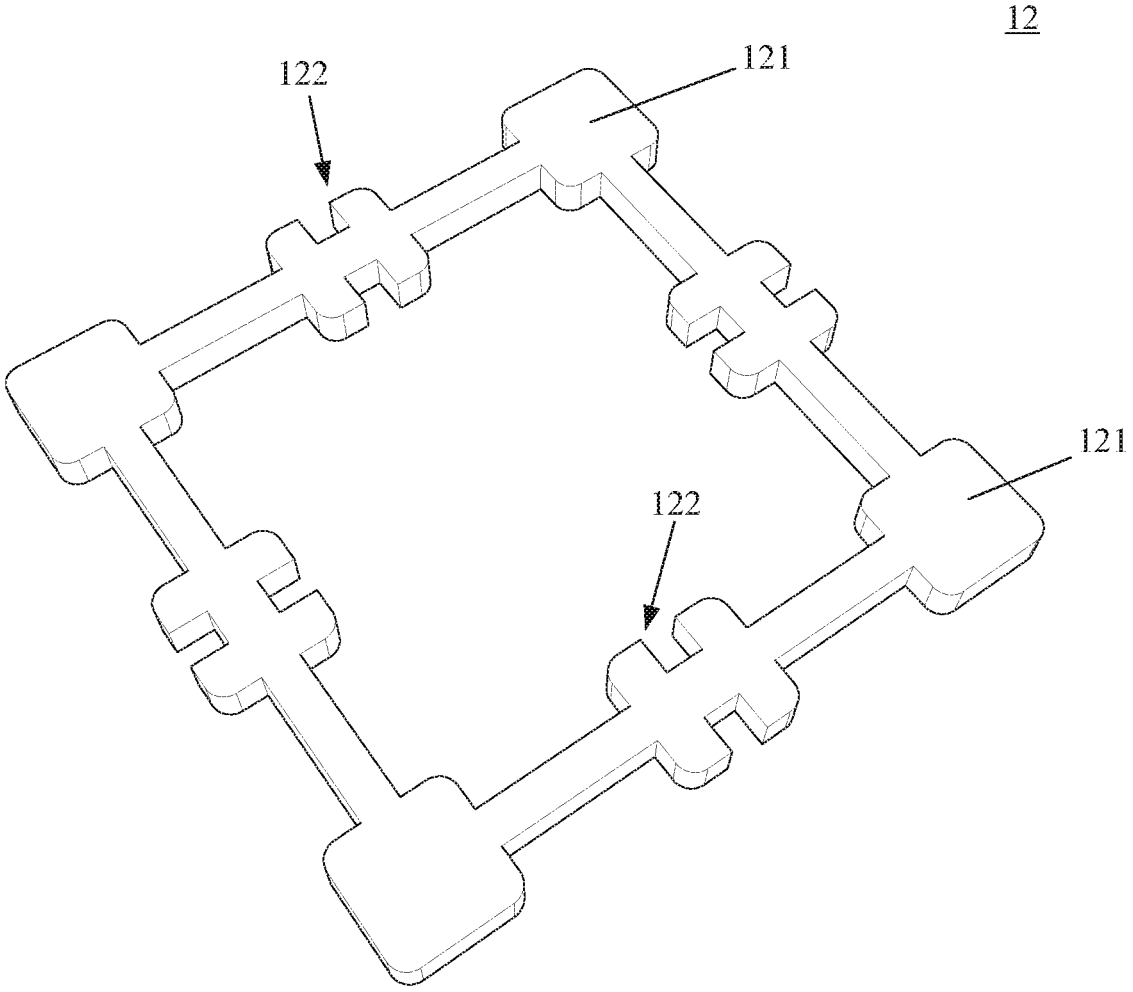
FIG. 8 is a schematic structural diagram of a second square frame in the three-dimensional game board of the present invention.
Figure 9:
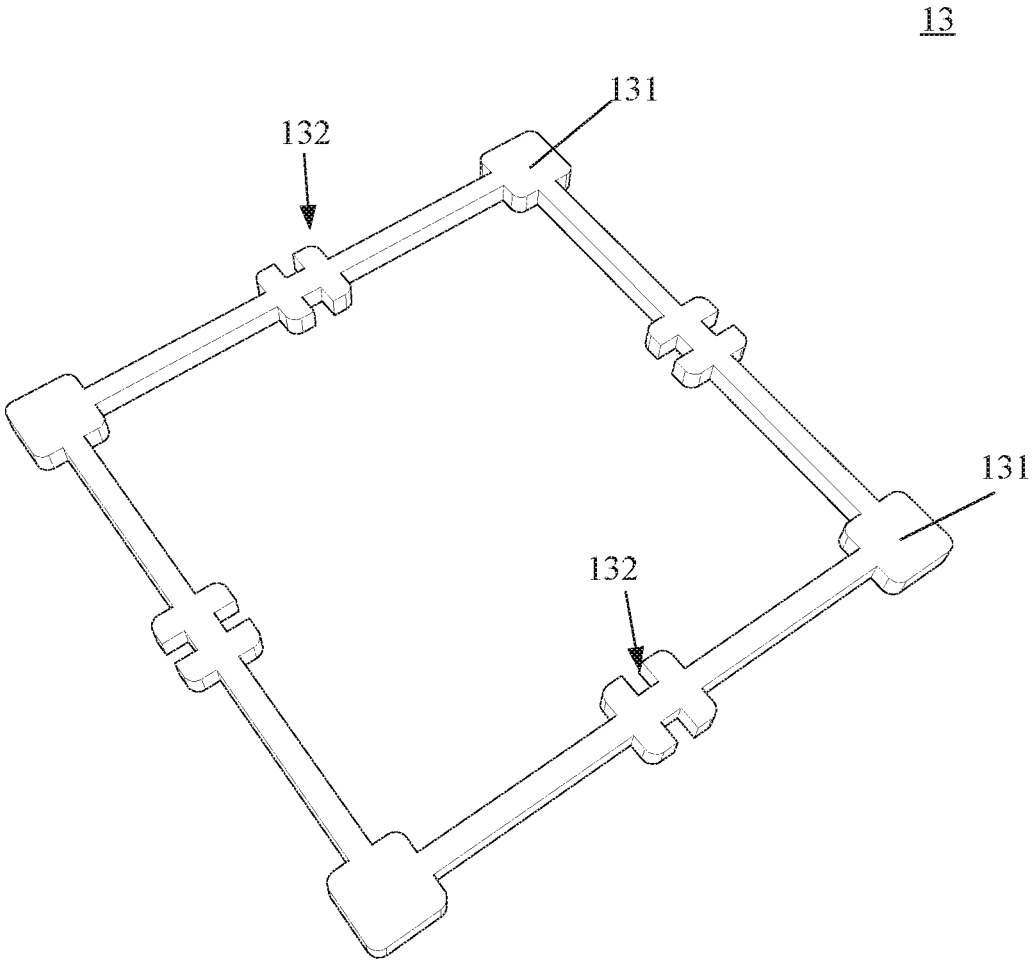
FIG. 9 is a schematic structural diagram of a third square frame in the three-dimensional game board of the present invention.
Figure 10:
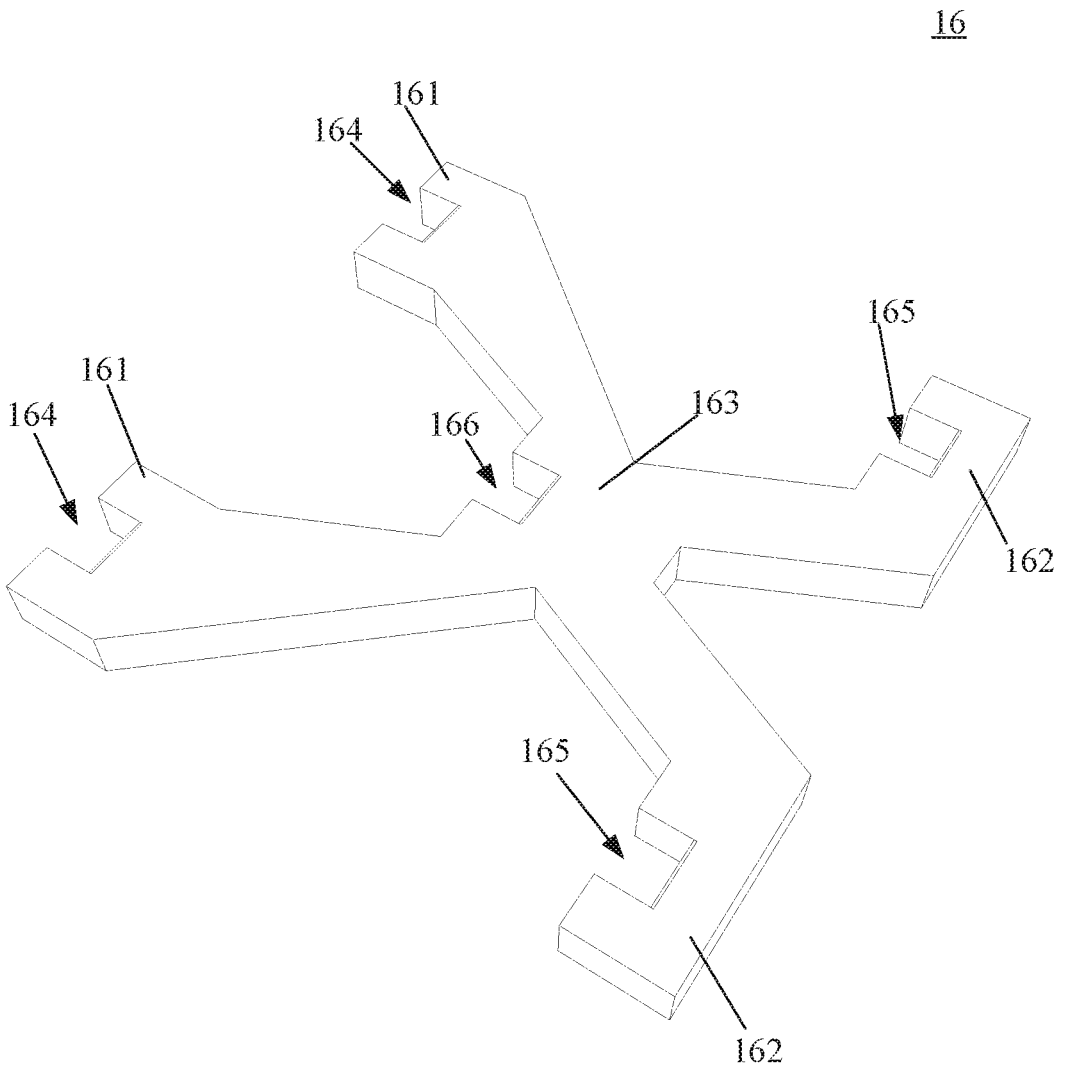
FIG. 10 is a schematic structural diagram of a support frame in the three-dimensional game board of the present invention.

FIG. 4 is a perspective view of a three-dimensional game board of the present invention. FIG. 5 is a schematic cutaway view along the line A-A in FIG. 4, wherein the three-dimensional game board is made of a transparent material. FIG. 6 is a schematic cutaway view along the line A-A in FIG. 4, wherein the three-dimensional game board is made of an opaque material. FIG. 7 is a schematic structural diagram of a first square frame in the three-dimensional game board of the present invention. FIG. 8 is a schematic structural diagram of a second square frame in the three-dimensional game board of the present invention. FIG. 9 is a schematic structural diagram of a third square frame in the three-dimensional game board of the present invention. FIG. 10 is a schematic structural diagram of a support frame in the three-dimensional game board of the present invention.

As shown in FIGS. 4 to 10, the present invention discloses a three-dimensional game board 10 comprising a first tier of board frame, a second tier of board frame, and a third tier of board frame. The first tier of board frame comprises a first square frame 11 and a second square frame 12. The second tier of board frame comprises a third square frame 13. The third tier of board frame comprises a fourth square frame 14 and a fifth square frame 15. Positions 111 are formed at four corners of the first square frame 11, positions 121 are formed at four corners of the second square frame 12, positions 131 are formed at four corners of the third square frame 13, positions 141 are formed at four corners of the fourth square frame 14, and positions 151 are formed at four corners of the fifth square frame 15. These positions 111, 121, 131, 141, and 151 are all used for setting pieces for the game.

Also, four support frames 16 are arranged among the square frames in each tier of the board frame, which connect the midpoints of corresponding sides of each of the square frames (i.e., the first square frame 11, the second square frame 12, the third square frame 13, the fourth square frame 14 and the fifth square frame 15) to form a three-dimensional game board, achieving a plurality of forms in which three pieces are in one straight line in a three-dimensional space.

Here, the size of the first square frame 11 is larger than that of the second square frame 12, and the size of the third square frame 13 is larger than that of the second square frame 12 and smaller than that of the first square frame 11. Meanwhile, the size of the fourth square frame 14 is equal to that of the first square frame 11, and the size of the fifth square frame 15 is equal to that of the second square frame 12.

Further preferably, the support frame 16 is an X-shaped support, and two upper legs 161 of the X-shaped support are connected to a midpoint of a corresponding side of the first square frame 11 and a midpoint of a corresponding side of the second square frame 12, respectively. Two lower legs 162 of the X-shaped support are connected to a midpoint of a corresponding side of the fourth square frame 14 and a midpoint of a corresponding side of the fifth square frame 15, respectively. A middle cross portion 163 of the X-shaped support is connected to a midpoint of a corresponding side of the third square frame 13. The X-shaped support here is detachably connected to each square frame, for example, it may include, but is not limited to various connection structures such as by magnet, fastener, plugging, or hook and loop, as long as the two are connected integrally.

More preferably, a recess 164 is provided in each of the two upper legs 161 of each of the X-shaped supports, a recess 165 is provided in each of the two lower legs 162 of each of the X-shaped supports, and a recess 166 is provided in the middle cross portion 163 of each of the X-shaped supports. Here, the two legs 161 are located in the same plane, and the two legs 162 are located in the same plane.

Also, an H-shaped junction 112 is arranged at a midpoint of each side of the first square frame 11, an H-shaped junction 122 is arranged at a midpoint of each side of the second square frame 12, an H-shaped junction 132 is arranged at a midpoint of each side of the third square frame 13, an H-shaped junction 142 is arranged at a midpoint of each side of the fourth square frame 14, and an H-shaped junction 152 is arranged at a midpoint of each side of the fifth square frame 15.

Each of the H-shaped junction 112 and the H-shaped junction 122 is integrally fastened to a corresponding recess 164 to form corresponding positions 113 and 123. Each H-shaped junction 132 is integrally fastened to a corresponding recess 166 to form a corresponding position 133. Each of the H-shaped junction 142 and the H-shaped junction 152 is integrally fastened to a corresponding recess 165 to form corresponding positions 143 and 153.

In this embodiment, the four X-shaped supports support each square frame in four orientations of a vertical plane, such that the three-dimensional structure is stabilized. Moreover, the X-shaped support here is not only a support member, but also is part of a position by itself, and such a structure can make each position be uniformly stressed at any angle and maintain robust.

In particular, at least one magnet may be preferably mounted on each of the H-shaped junctions, and at least one metal piece is disposed in each of the recesses, such that the recesses and the corresponding H-shaped junctions that are fastened to each other are magnetically attracted together. Alternatively, at least one magnet may be mounted in the recess, and at least one metal piece is disposed on each of the H-shaped junctions, such that the H-shaped junctions and the corresponding recesses that are fastened to each other are magnetically attracted together. Magnets are used to connect connection points of the three-dimensional game board, which can be easily disassembled and assembled and has a logistics advantage. Still alternatively, at least one magnet may be mounted on the H-shaped junction and in the recess, respectively, and the H-shaped junction and the recess are connected by means of attraction between magnets.

Of course, other structures may also be used for the connection between the X-shaped support and each square frame. For example, the H-shaped junctions are arranged on the two upper legs, the two lower legs and the middle cross portion of each of the X-shaped supports. Correspondingly, a recess protruding downward is provided at the midpoint of each side of each square frame, and each of the H-shaped junctions and the corresponding recess are fastened to each other, such that the X-shaped supports are connected to the square frames to form a three-dimensional game board.

It can be seen that various forms of the connection structure between the X-shaped support and each square frame may be used and are not limited to the above examples as long as the two are connected integrally, and all fall within the scope of protection of the present invention.

In addition, the three-dimensional game board of the present invention may be preferably made of transparent, opaque, or hollow material (as shown in FIGS. 5 and 6), etc., including but not limited to materials such as acrylic, stainless steel, glass, plastic, crystal, aluminum, wood, bamboo, metal, or carbon, such that the structure of the three-dimensional game board is more portable and exquisite. The positions involved in the three-dimensional game board may have various shapes, including but not limited to square with rounded corners, square, circle, triangle, or polygon or the like. The support frame may also have a shape and structure similar to the X-shaped support.

Of course, the number of the tiers of the three-dimensional game board can be increased or decreased, various changes may be made to the material and color of the three-dimensional game board, and the size of the three-dimensional game board can also be changed differently. All the above contents can be reasonably developed as long as the technical solution of the present invention can be implemented, are not limited by the above examples, and all fall within the scope of protection of the present invention.

Figure 11:
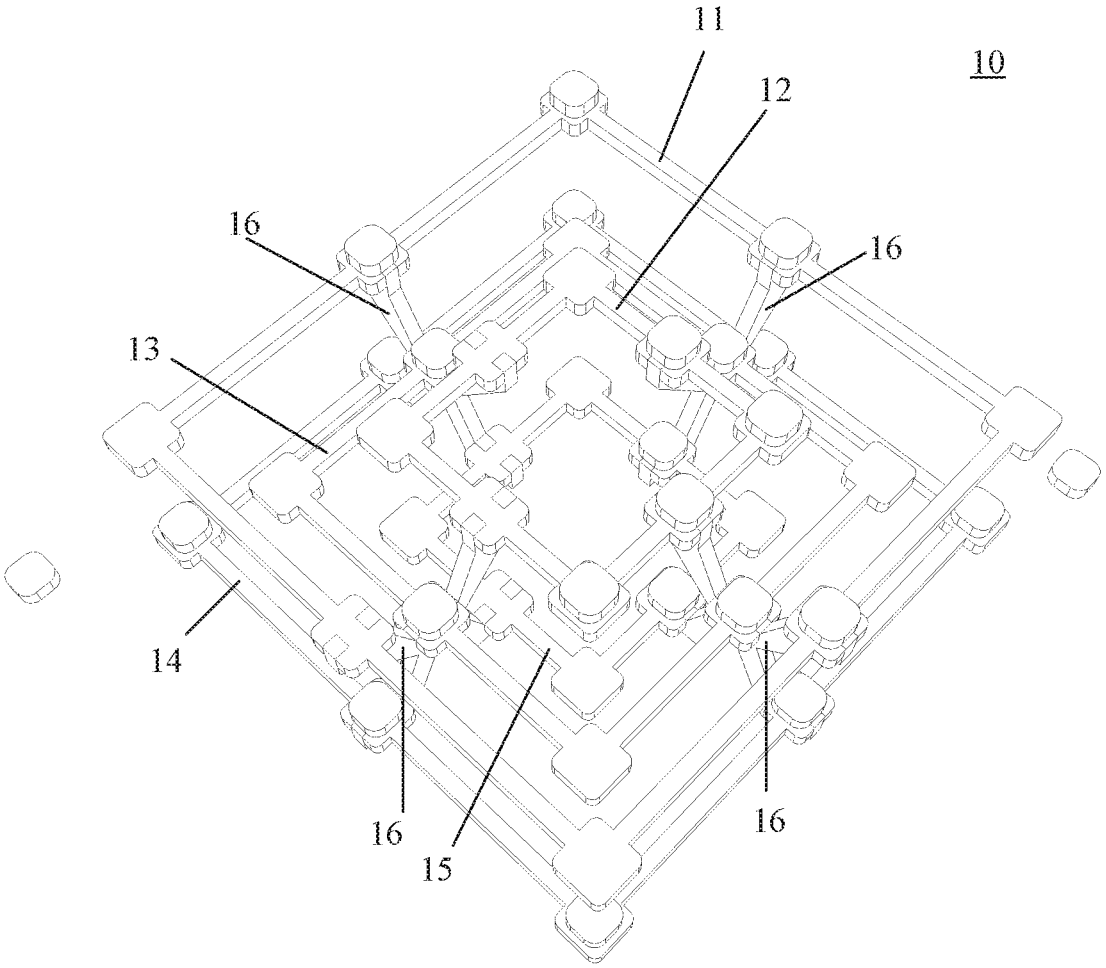
FIG. 11 is a game state diagram of the three-dimensional game board of the present invention.

FIG. 11 is a game state diagram of the three-dimensional game board of the present invention. As shown in FIG. 11, when the three-dimensional game board is used, the game starts with an empty board. Players first decide who will play first and then take turns placing their pieces on empty positions on the board. If one player can place his three pieces horizontally or vertically or diagonally in one straight line, he has created a "mill" (factory or territory) and may remove one piece of his opponent from the board and the game. A piece to be removed may be selected, except for those in a "mill" (factory or territory) that the opponent has created.

When all the pieces are placed, the players continue to take turns moving the pieces, and at this point a piece may be moved to an adjacent position. One piece cannot jump over another piece. The players continue to try to form "mills" (factories or territories) and remove the opponent's pieces. The players may break their own "mill" (factory or territory) that has been formed and move one of the pieces therefrom, and then repeatedly move the piece back to create the same "mill" (factory or territory), and each time the piece is moved back, one of the pieces of the opponent may be removed.

When one player's pieces on the board are reduced to the last three ones, the player is no longer restricted to move his piece only to an adjacent position, instead the player's piece can "fly" from any position to any empty position. The game ends when one player has only the last 2 pieces left or cannot make any further movement on the board, then his opponent wins.

Figure 12:
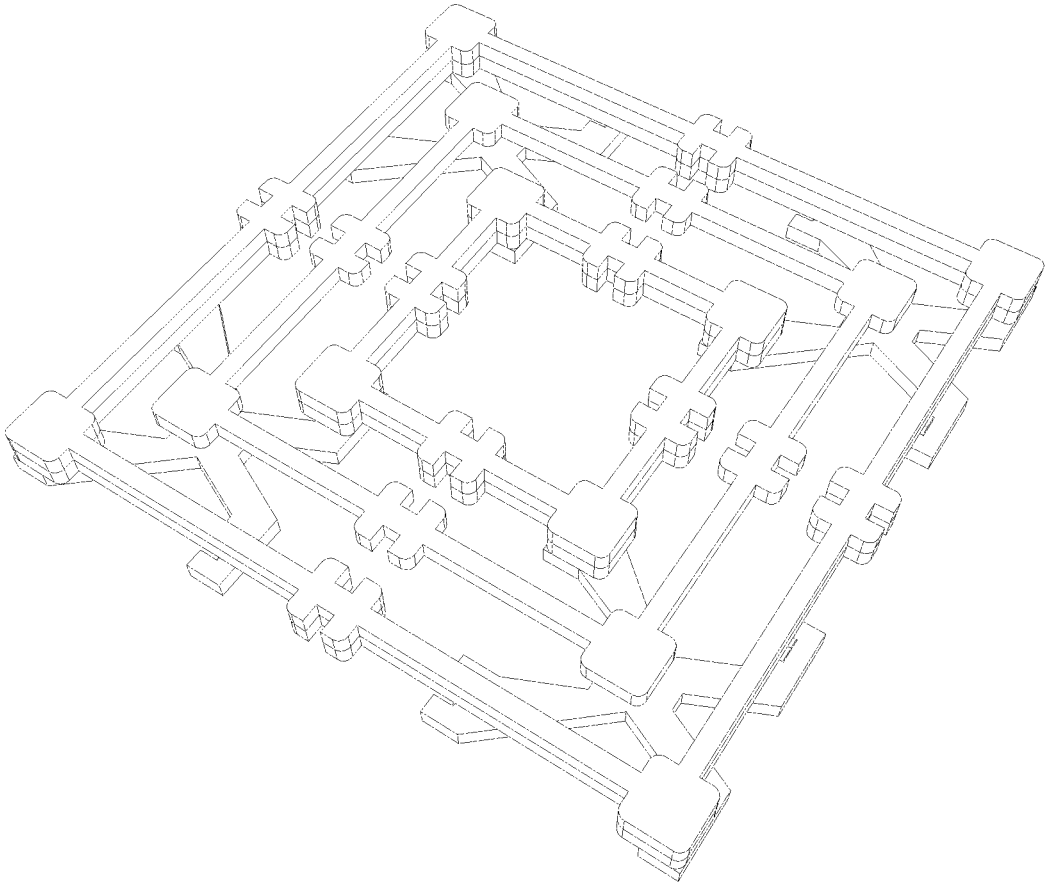
FIG. 12 is a stored state diagram of the three-dimensional game board of the present invention.

FIG. 12 is a stored state diagram of the three-dimensional game board of the present invention. As shown in FIG. 12, when the game ends, since the three-dimensional game board of the present invention is designed with a detachable structure, the square frames can be detached from the support frames, and then are arranged in a packaging box in order, the board can be immediately stored in a planar state.

In this way, the entire three-dimensional game board can be flexibly disassembled and stored, and is easy to carry and more functional.

According to the structural description of the foregoing embodiment, it can be known that, in this embodiment, the three-dimensional game board is configured as a three-dimensional structure and is detachable. After the board is assembled, the structure is three-dimensional and has three tiers, wherein the first tier has 16 positions, the second tier (middle tier) has 8 positions, and the third tier (bottom tier) has 16 positions. Four X-shaped supports are used to connect the three tiers. The three-dimensional game board, when disassembled, has 9 components, and the components are connected by magnets and metal pieces. Each connection point has a specific position in the structure, such that the structure of the connected three-dimensional game board is more robust and portable.

In summary, the three-dimensional game board of the present invention breaks through the limitation of planar board, which is redesigned into a three-dimensional game board, and incorporates the concept of three-dimensional space, such that the original planar game is able to be played in a three-dimensional space. The three-dimensional game board makes the game more strategic, intellectual and interesting, and improves the spatial cognition and game experience of players.

In addition, in the three-dimensional game board of the present invention, the structure of the three-dimensional game board is further configured to be detachable, such that the board can be assembled or disassembled simply and easily. In this way, the game board can be conveniently stored, managed, carried or transported, which not only saves on space but also has a logistics advantage. No matter in a three-dimensional state or in a stored state after disassembly, the three-dimensional game board exhibits a stylish line structure with both functionality and aesthetics.

Although the specific implementations of the present invention are described above, a person skilled in the art should understand that these are only exemplary, and the scope of protection of the present invention is defined by the appended claims. Various alterations or modifications to these implementations can be made by a person skilled in the art without departing from the principle and essence of the present invention; however, these alterations and modifications all fall within the scope of protection of the present invention.

What is claimed is:

1. A three-dimensional game board, comprising:

a first tier of a board frame, a second tier of the board frame, and a third tier of the board frame arranged up and down, the first tier of the board frame comprising a first square frame and a second square frame, the second tier of the board frame comprising a third square frame, and the third tier of the board frame comprising a fourth square frame and a fifth square frame, a size of a square frame of a tier is varied from a square frame of an adjacent tier, and on each square frame, a position for setting a piece being provided on each of four corners and on a midpoint of each of four sides; and four support frames are arranged among at least one square frame in each tier of the board frame, which connect the positions at the midpoints of corresponding sides of each square frame to form the three-dimensional game board, achieving a plurality of forms in which three pieces are in one straight line in a three-dimensional space.

2. The three-dimensional game board of claim 1, wherein the first square frame is larger than the second square frame, and the third square frame is larger than the second square frame and smaller than the first square frame; and the size of the fourth square frame is equal to that of the first square frame, and the size of the fifth square frame is equal to that of the second square frame.

3. The three-dimensional game board of claim 2, wherein the support frame is an X-shaped support, two upper legs of the X-shaped support being respectively connected to the first square frame and the second square frame, two lower legs of the X-shaped support being respectively connected to the fourth square frame and the fifth square frame, and a middle cross portion of the X-shaped support being connected to the third square frame.

4. The three-dimensional game board of claim 3, wherein the X-shaped support is detachably connected to each square frame.

5. The three-dimensional game board of claim 4, wherein each of the two upper legs, the two lower legs, and the middle cross portion of each of the X-shaped supports is provided with a recess, an H-shaped junction is arranged at a midpoint of each side of the first square frame, the second square frame, the third square frame, the fourth square frame and the fifth square frame, and each of the H-shaped junctions is integrally fastened to the corresponding recess to form the positions of the midpoints.

6. The three-dimensional game board of claim 5, wherein at least one magnet is mounted on each of the H-shaped junctions, and at least one metal piece is disposed in each of the recesses, such that each of the recesses and each of the corresponding H-shaped junctions are magnetically attracted together; or at least one magnet is mounted in each of the recesses, and at least one metal piece is disposed on each of the H-shaped junctions, such that each of the H-shaped junctions and each of the corresponding recesses are magnetically attracted together.

7. The three-dimensional game board of claim 5, wherein each of the H-shaped junctions and each of the recesses are connected by means of at least one fastener, plugging, or at least one hook and loop.

8. The three-dimensional game board of claim 5, wherein at least one magnet is mounted on each of the H-shaped junctions and in each of the recesses, respectively, and each of the H-shaped junctions and each of the recesses are connected by means of attraction between magnets.

9. The three-dimensional game board of claim 4, wherein the three-dimensional game board is made of acrylic, stainless steel, glass, plastic, crystal, aluminum, wood, bamboo, metal, or carbon.

10. The three-dimensional game board of any one of the preceding claims, wherein each of the positions of the midpoints and four corners is in the shape of a square with rounded corners, a square, a circle, a triangle, or a polygon.

* * * * *